US011171395B2

(12) United States Patent
Arai et al.

(10) Patent No.: US 11,171,395 B2
(45) Date of Patent: Nov. 9, 2021

(54) TRANSMISSION LINE AND AIR BRIDGE STRUCTURE

(71) Applicant: ANRITSU CORPORATION, Kanagawa (JP)

(72) Inventors: Shigeo Arai, Kanagawa (JP); Yuji Sekine, Kanagawa (JP); Michihiko Ikeda, Kanagawa (JP)

(73) Assignee: ANRITSU CORPORATION, Kanagawa (JP)

( * ) Notice: Subject to any disclaimer, the term of this patent is extended or adjusted under 35 U.S.C. 154(b) by 107 days.

(21) Appl. No.: 16/773,157

(22) Filed: Jan. 27, 2020

(65) Prior Publication Data

US 2020/0251796 A1 Aug. 6, 2020

(30) Foreign Application Priority Data

Jan. 31, 2019 (JP) ..... JP2019-015124

(51) Int. Cl.

*H01P 1/02* (2006.01)
*H01P 5/02* (2006.01)
*H01P 3/00* (2006.01)

(52) U.S. Cl.

CPC ..... *H01P 1/022* (2013.01); *H01P 3/006* (2013.01); *H01P 5/022* (2013.01); *H01P 5/028* (2013.01)

(58) Field of Classification Search

CPC ..... H01P 1/022; H01P 5/022; H01P 3/006; H01P 5/028; H01P 3/003; H01P 1/2013; H01P 1/026

USPC ..... 333/24 R, 186, 173, 204, 246, 99 S

See application file for complete search history.

(56) References Cited

U.S. PATENT DOCUMENTS

2008/0272857 A1* 11/2008 Singh ..... H01P 3/081 333/161
2011/0042672 A1* 2/2011 Makita ..... H01P 3/003 257/51
2015/0255847 A1* 9/2015 Reza ..... H01P 3/003 333/238

FOREIGN PATENT DOCUMENTS

JP 2012-090207 A 5/2012

* cited by examiner

*Primary Examiner* — Robert J Pascal
*Assistant Examiner* — Jorge L Salazar, Jr.
(74) *Attorney, Agent, or Firm* — Pearne & Gordon LLP

(57) ABSTRACT

An object is to provide a transmission line having an air bridge structure in which grounding conductors of a transmission line are connected by wiring and which is stable in terms of mechanical strength by lowering an electrostatic capacitance in a region where the wirings connecting the central conductor and the grounding conductor intersect with each other. The transmission line includes a substrate, a first central conductor and a second central conductor that are formed on a surface of the substrate, a third central conductor that has a first erection portion and a second erection portion erected on the surface, and a first grounding conductor and a second grounding conductor. The transmission line further includes a third grounding conductor connecting the first grounding conductor and the second grounding conductor. The third central conductor and the third grounding conductor form an air bridge structure.

15 Claims, 17 Drawing Sheets

BB' Cross section

CC' Cross section

DD' Cross section

TRANSMISSION LINE AND AIR BRIDGE STRUCTURE

TECHNICAL FIELD

The present invention relates to an air bridge structure used in a case of connecting ground electrodes of a transmission line.

BACKGROUND ART

In a coplanar line (coplanar waveguide, hereinafter referred to as CPW line) used in a circuit or the like formed on a semiconductor substrate, it is necessary to make potentials of the grounding conductors equal in order to suppress occurrence of the slot mode.

The CPW line has a structure having grounding conductors on both sides of the central conductor. To make the potentials of the grounding conductors equal, the grounding conductors on both sides of the central conductor have to be connected. The air bridge structure used here is a structure in which wiring connecting the grounding conductors is provided in a layer different from the central conductor through which the signal propagates.

In this air bridge structure, the wirings connecting the signal line and the grounding conductor intersect with each other through air. At this time, a capacitance is generated in the portion where the signal line and the wiring overlap, and this capacitance functions as a parallel parasitic capacitance. This parasitic capacitance contributes to cause an increase in reflection and delay of a signal propagating through the signal line due to impedance mismatch in accordance with a decrease in the characteristic impedance of the CPW line.

FIG. 15 shows a CPW line having a conventional air bridge structure described in Patent Document 1. The CPW line 10 includes a substrate 11, a central conductor 12 formed on the substrate 11, grounding conductors 13 and 14 provided on both sides of the central line, and a wiring 15 that connects the grounding conductors 13 and 14. The wiring 15 has erection portions 15*a* and 15*b* erected on the surface of the substrate, and the erection portions 15*a* and 15*b* are respectively erected on the grounding conductors 13 and 14 so as to be across the central line 12, thereby forming an air bridge structure.

FIG. 16 is a top view of the CPW line 10. A region surrounded by a dashed line is an intersection region formed by the central conductor 12 having a width of ws μm and the wiring 15 having a width of wo μm, and the area S0 of the intersection region is S0=wo×ws $\mu m^2$.

FIG. 17 is a cross-sectional view of the CPW line 10 which is cut by a plane normal to the direction in which the central conductor including DD' passing through the center of the wiring 15 extends. Between the upper surface of the central conductor 12 and the lower surface of the wiring 15, a gap having a thickness of t0 μm corresponding to the heights of the erection portions 15*a* and 15*b* is generated.

In a case where a predetermined voltage is applied to the central conductor 12 and the wiring 15 is grounded, the intersection region functions as a capacitor having a dielectric constant of air, and the electrostatic capacitance proportional to the ratio S0/t0 of the area S0 and the thickness t0 is generated. Since this electrostatic capacitance is added in parallel to the original impedance of the CPW line 10, the characteristics of the coplanar line such as an increase in propagation loss and an increase in reflection are deteriorated.

RELATED ART DOCUMENT

[Patent Document]

Japanese Patent Application No. 2010-237204

DISCLOSURE OF THE INVENTION

Problem that the Invention is to Solve

In order to prevent the deterioration of the characteristics of the CPW line 10, it is necessary to reduce the electrostatic capacitance of the intersection region. However, in the structure in which the wiring connecting the grounding conductors is provided so as to be across the central conductor, a space is generated between the central conductor and the wiring, and a certain mechanical strength is required for the wiring 15 to maintain the shape as a structure. Therefore, in a case where the wiring width wo is reduced in order to reduce the capacitance of the intersection region, the mechanical strength of the entire wiring having the air bridge structure is weakened, and the shape of the wiring 15 may be collapsed or broken in a case where a slight impact or bending is applied.

The present invention has been made in view of such problems, and has an object to provide an air bridge structure and a transmission line having such an air bridge structure in which the grounding conductors of the transmission line are connected by wiring. The air bridge structure is stable in terms of mechanical strength by lowering the electrostatic capacitance of the region where the wirings connecting the central conductor and the grounding conductor intersect with each other.

Means for Solving the Problem

In order to achieve the above object, a transmission line according to claim 1 of the present invention is configured to include: a substrate; a first central conductor and a second central conductor that are formed with a same width on a same straight line on one surface of the substrate, and a third central conductor that has a first erection portion and a second erection portion erected on the one surface; a first grounding conductor and a second grounding conductor that have edges parallel to the first central conductor and the second central conductor and are separated from the first central conductor and the second central conductor by a same distance so as to be opposed to each other; and a third grounding conductor that connects the first grounding conductor and the second grounding conductor, is disposed between an end portion of the first central conductor and an end portion of the second central conductor facing the end portion of the first central conductor, and has a width narrower than a width of the third central conductor. The first erection portion is disposed at the end portion of the first central conductor, and the second erection portion is disposed at the end portion of the second central conductor. In addition, the third central conductor and the third grounding conductor form an air bridge structure.

With this configuration, it is possible to suppress occurrence of electrostatic capacitance in a region where the central conductor and the wiring connecting the grounding conductors intersect with each other, and to reduce an increase in propagation loss and an increase in reflection.

In order to achieve the above object, in the transmission line according to claim 2 of the present invention, it is preferable that the third grounding conductor is disposed at the center between the end portion of the first central conductor and the end portion of the second central conductor.

With this configuration, by making the distance from the wiring to the end portion of the central conductor the same, it is possible to minimize the component due to the dielectric constant of the substrate in the electrostatic capacitance parasitic on the impedance of the CPW line.

In order to achieve the above object, in the transmission line according to claim 3 of the present invention, it is preferable that a width of the third grounding conductor is ⅓ or less of the width of the third central conductor.

With this configuration, a transmission line with less propagation loss can be realized.

In order to achieve the above object, in the transmission line according to claim 4 of the present invention, it is preferable that the substrate is formed of a substrate body as a main body and a first layer on an upper surface of the substrate body. In addition, it is preferable that the third grounding conductor is disposed on the upper surface of the substrate body and is connected to the grounding conductors on the upper surface of the first layer.

With this configuration, the pattern formation of the central conductor and the grounding conductor of the transmission line can be performed with high accuracy or stability.

In order to achieve the above object, in the transmission line according to claim 5 of the present invention, it is preferable that a width of the third grounding conductor is ⅓ or less of the width of the third central conductor.

In order to achieve the above object, in the transmission line according to claim 6 of the present invention, it is preferable that the substrate is formed of a substrate body as a main body and a first layer on an upper surface of the substrate body. In addition, it is preferable that the third grounding conductor is disposed on the upper surface of the substrate body and is connected to the grounding conductors on the upper surface of the first layer.

In order to achieve the above object, in the transmission line according to claim 7 of the present invention, it is preferable that the substrate is formed of a substrate body as a main body and a first layer on an upper surface of the substrate body. In addition, it is preferable that the third grounding conductor is disposed on the upper surface of the substrate body and is connected to the grounding conductors on the upper surface of the first layer.

In order to achieve the object, an air bridge structure according to claim 8 of the present invention includes: a substrate; central conductors provided on the substrate; and grounding conductors. it is preferable that a part of the central conductor is separated from the substrate, and a part of the grounding conductor is disposed under the part of the central conductor. In addition, it is preferable that a width of the part of the grounding conductor is narrower than a width of the part of the central conductor.

With this configuration, it is possible to suppress occurrence of electrostatic capacitance in a region where the central conductor and the wiring connecting the grounding conductors intersect with each other, and to reduce an increase in propagation loss and an increase in reflection.

In order to achieve the object, in the air bridge structure according to claim 9 of the present invention, it is preferable that the central conductors include a first central conductor and a second central conductor that are formed with a same width on a same straight line on one surface of the substrate, and a third central conductor that has a first erection portion and a second erection portion erected on the surface. The grounding conductors include a first grounding conductor and a second grounding conductor that have edges parallel to the first central conductor and the second central conductor and are separated from the first central conductor and the second central conductor by a same distance so as to be opposed to each other, and a third grounding conductor that connects the first grounding conductor and the second grounding conductor, is disposed between an end portion of the first central conductor and an end portion of the second central conductor facing the end portion of the first central conductor, and has a width smaller than a width of the third central conductor. It is preferable that the first erection portion is disposed at the end portion of the first central conductor, and the second erection portion is disposed at the end portion of the second central conductor. In addition, it is preferable that the third central conductor and the third grounding conductor form an air bridge structure.

In order to achieve the object, in the air bridge structure according to claim 10 of the present invention, it is preferable that the third grounding conductor is disposed at the center between the end portion of the first central conductor and the end portion of the second central conductor.

In order to achieve the object, in the air bridge structure according to claim 11 of the present invention, it is preferable that a width of the third grounding conductor is ⅓ or less of the width of the third central conductor.

In order to achieve the object, in the air bridge structure according to claim 12 of the present invention, it is preferable that a width of the third grounding conductor is ⅓ or less of the width of the third central conductor.

In order to achieve the object, in the air bridge structure according to claim 13 of the present invention, it is preferable that the substrate is formed of a substrate body as a main body and a first layer on an upper surface of the substrate body. In addition, it is preferable that the third grounding conductor is disposed on the upper surface of the substrate body and is connected to the grounding conductors on the upper surface of the first layer.

In order to achieve the object, in the air bridge structure according to claim 14 of the present invention, it is preferable that the substrate is formed of a substrate body as a main body and a first layer on an upper surface of the substrate body. In addition, it is preferable that the third grounding conductor is disposed on the upper surface of the substrate body and is connected to the grounding conductors on the upper surface of the first layer.

In order to achieve the object, in the air bridge structure according to claim 15 of the present invention, it is preferable that the substrate is formed of a substrate body as a main body and a first layer on an upper surface of the substrate body. In addition, it is preferable that the third grounding conductor is disposed on the upper surface of the substrate body and is connected to the grounding conductors on the upper surface of the first layer.

Advantage of the Invention

The present invention provides a transmission line that realizes deterioration of transmission characteristics and reflection characteristics by providing an air bridge structure formed such that a central conductor is across the wiring connecting grounding conductors.

BRIEF DESCRIPTION OF THE DRAWINGS

FIG. 7A shows a conventional configuration, and FIG. 7B shows a configuration according to the first embodiment.

BEST MODE FOR CARRYING OUT THE INVENTION

First Embodiment

Hereinafter, a first embodiment of the present invention will be described with reference to the drawings.

Figure 1:
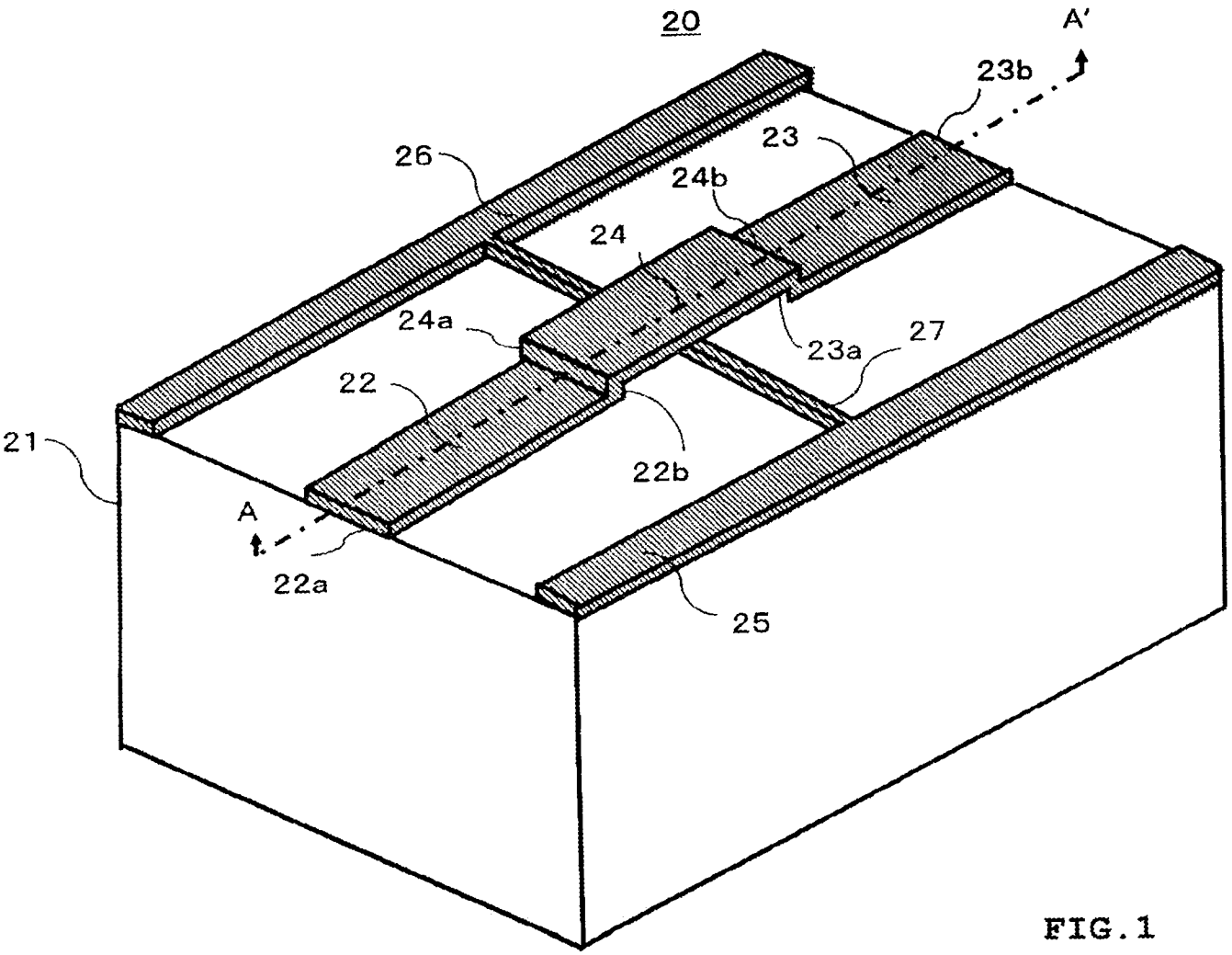
FIG. 1 is a diagram showing a configuration of a CPW line according to a first embodiment of the present invention.

FIG. 1 shows a configuration of a CPW line 20 to which the present invention is applied.

The CPW line 20 includes a substrate 21, central conductors 22, 23 and 24, grounding conductors 25 and 26, and wiring 27. The substrate 21 can be made of a material such as a semiconductor or a dielectric, and GaAs which is a compound semiconductor is used in this embodiment. The substrate 21 may have a structure made of a single material or a structure in which a plurality of materials are laminated, and can be selected as appropriate.

Central conductors are formed on the surface of the substrate. The central conductors each extending linearly include a first central conductor 22, a second central conductor 23, and a third central conductor 24. The third central conductor 24 has first and second erection portions 24*a* and 24*b* at both end portions. The end portion 22*a* of the first central conductor 22 is used as an input end portion to which a high frequency signal is input, and the first erection portion 24*a* is disposed at the other end portion 22*b*. The second central conductor 23 is spaced from the first central conductor 22, and the second erection portion 24*b* is disposed at the end portion 23*a* of the second central conductor 23 opposed to the other end portion 22*b* of the first central conductor 22. The other end portion 23*b* of the second central conductor 23 is used as an output end portion, and a high frequency signal is output. It should be noted that the term "opposed" means a state of facing each other.

The first erection portion 24*a* and the second erection portion 24*b* formed at both end portions of the third central conductor 24 are erected on the upper surface of the substrate 21. By providing the erection portions, the third central conductor 24 can be arranged in a different layer from the first central conductor 22 and the second central conductor 23. In addition, a gap having an interval $t_1$ is generated below the third central conductor 24, and this gap can be used to intersect with another wiring. The shape of each erection portion is not necessarily a shape perpendicular to the upper surface of the substrate 21. In a case where the third central conductor 24 can be arranged in the first central conductor 22 and the second central conductor 23 in different layers, the shape of the erection portion may be a smooth curved shape.

The grounding conductors 25 and 26 are disposed on both sides of the central conductors 22, 23 and 24. The grounding conductors 25 and 26 are connected by a wiring 27.

The central conductors 22, 23, and 24, the grounding conductors 25 and 26 and the wiring 27 are metal thin films. In the present embodiment, the central conductors 22 and 23, the grounding conductors 25 and 26, and the wiring 27 each have a thickness of 1.5 μm, and the central conductor 24 has a thickness of 3 μm. Depending on the application, each thickness can be set as appropriate, and is not limited to these values.

Figure 2:
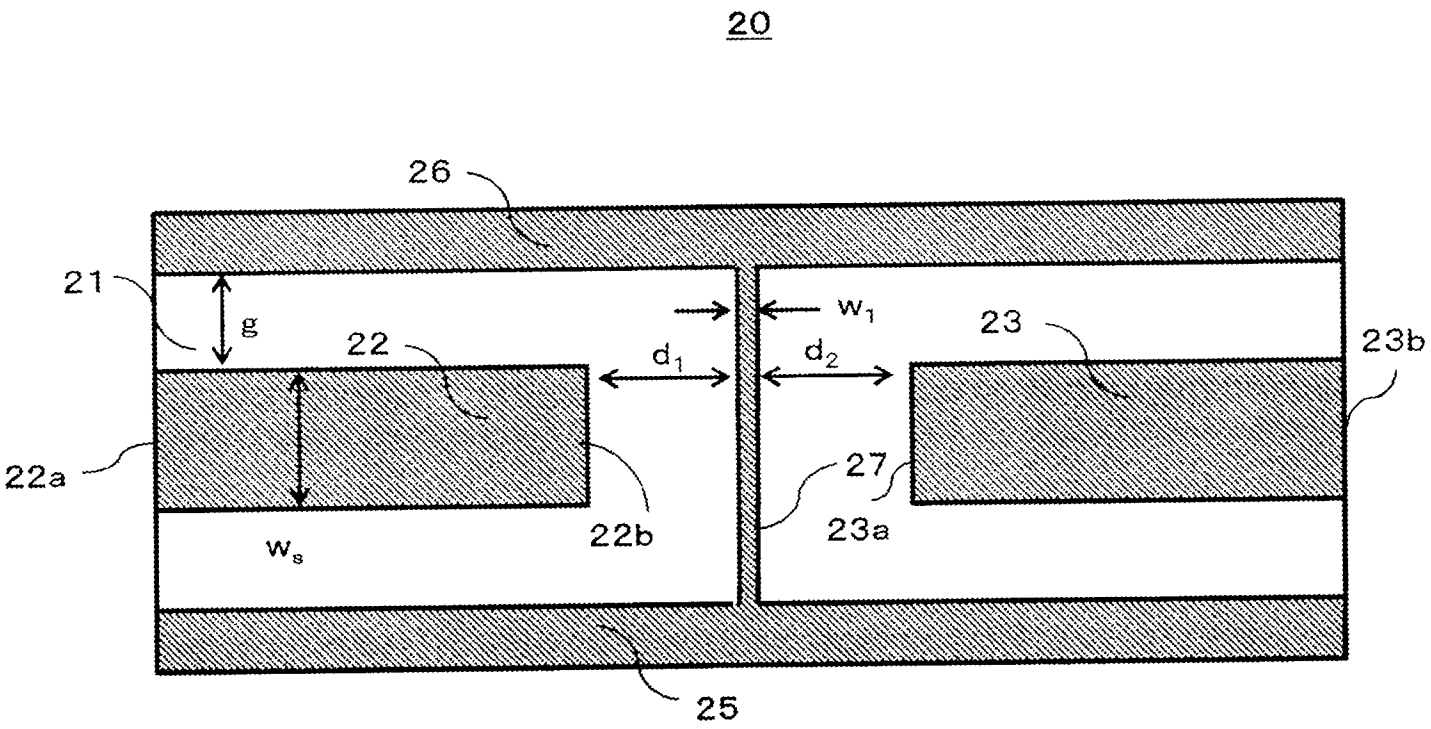
FIG. 2 is a cross-sectional view of the CPW line according to the first embodiment of the present invention.

FIG. 2 is a cross-sectional view of the CPW line 20 in a case where the upper surfaces of the central conductors 22 and 23 are taken as a cross section. The first central conductor 22, the second central conductor 23, the grounding conductors 25 and 26, and the wiring 27 are all formed in the same layer. The distance between the edges of the central conductors 22 and 23 and the edges of the grounding conductors 25 and 26 is g μm. The width of the first central conductor 22 and the width of the second central conductor 23 each are ws μm, and the width of the wiring 27 connecting the grounding conductors 25 and 26 is w1 μm. In the present embodiment, ws=30 μm, g=20 μm, and w1<ws. Considering the simulation result described later, it is desirable that w1≤ws/3.

The wiring 27 is disposed between the end portion 22*b* of the first central conductor 22 and the end portion 23*a* of the second central conductor 23. Here, in a case where the distance from the end portion 22*b* of the first central conductor 22 to the wiring 27 is $d_1$, and the distance from the end portion 23*b* of the second central conductor 23 to the wiring 27 is $d_2$, $d_1=d_2$, which is established in a case where the wiring 27 is disposed in the center.

The edges of the grounding conductors 25 and 26 are parallel to the direction in which the central conductor extends, and the wiring 27 is perpendicular to the edges of the grounding conductors 25 and 26 and connects the grounding conductors 25 and 26 on both sides of the central conductor.

Figure 3:
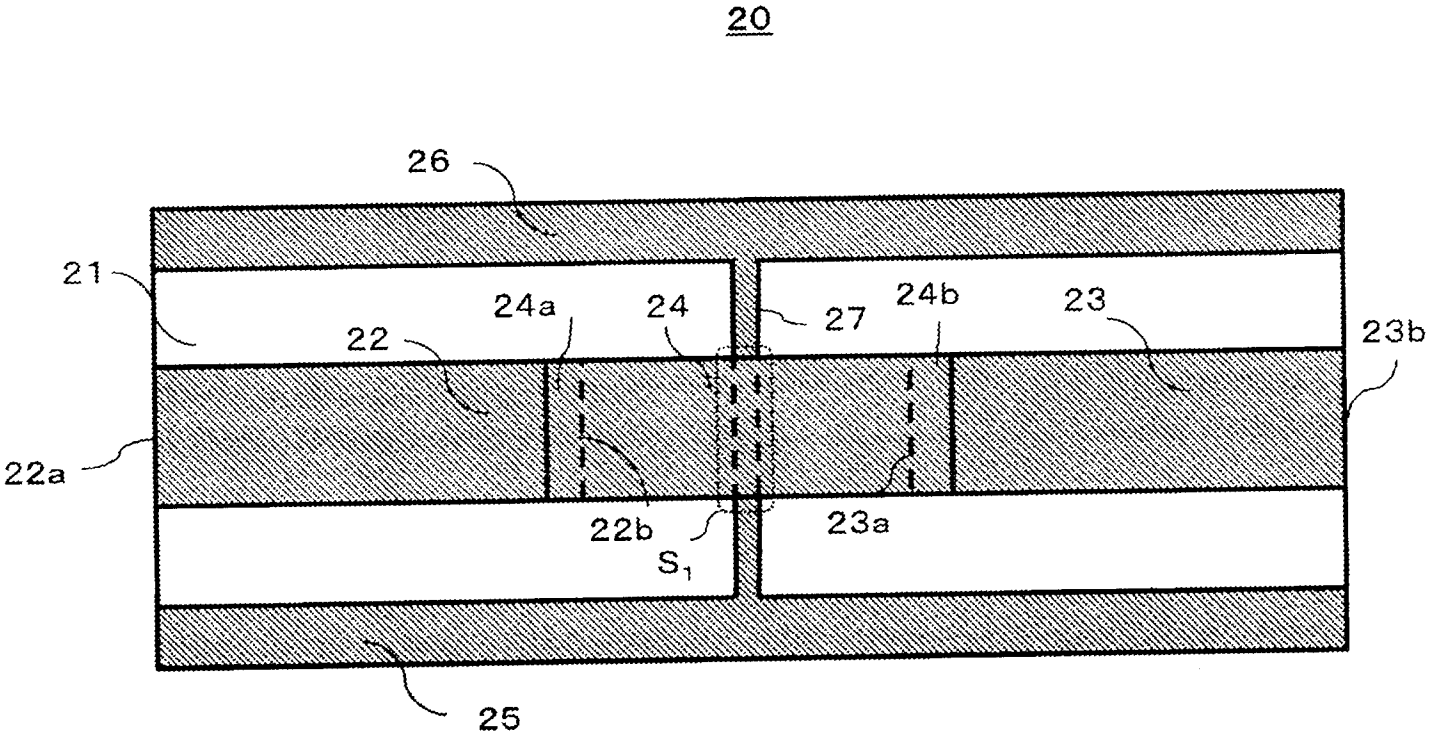
FIG. 3 is a top view of the CPW line according to the first embodiment of the present invention.

FIG. 3 is a top view of the CPW line 20. The third central conductor 24 is positioned on a layer at a height corresponding to the height of each erection portion with respect to the surface of the substrate by the erection portions 24*a* and 24*b* at both end portions of the third central conductor 24 disposed at the end portion 22*b* of the first central conductor 22 and the end portion 23*a* of the second central conductor 23. The third central conductor 24 has the same width ws as the first central conductor 22 and the second central conductor 23. A part surrounded by the dashed line in FIG. 3 is a region where the third central conductor 24 having the width ws intersects with the wiring 27 having the width w1. The area S1 $\mu m^2$ of the intersection region is represented by S1=ws×w1 $\mu m^2$.

Figure 4:
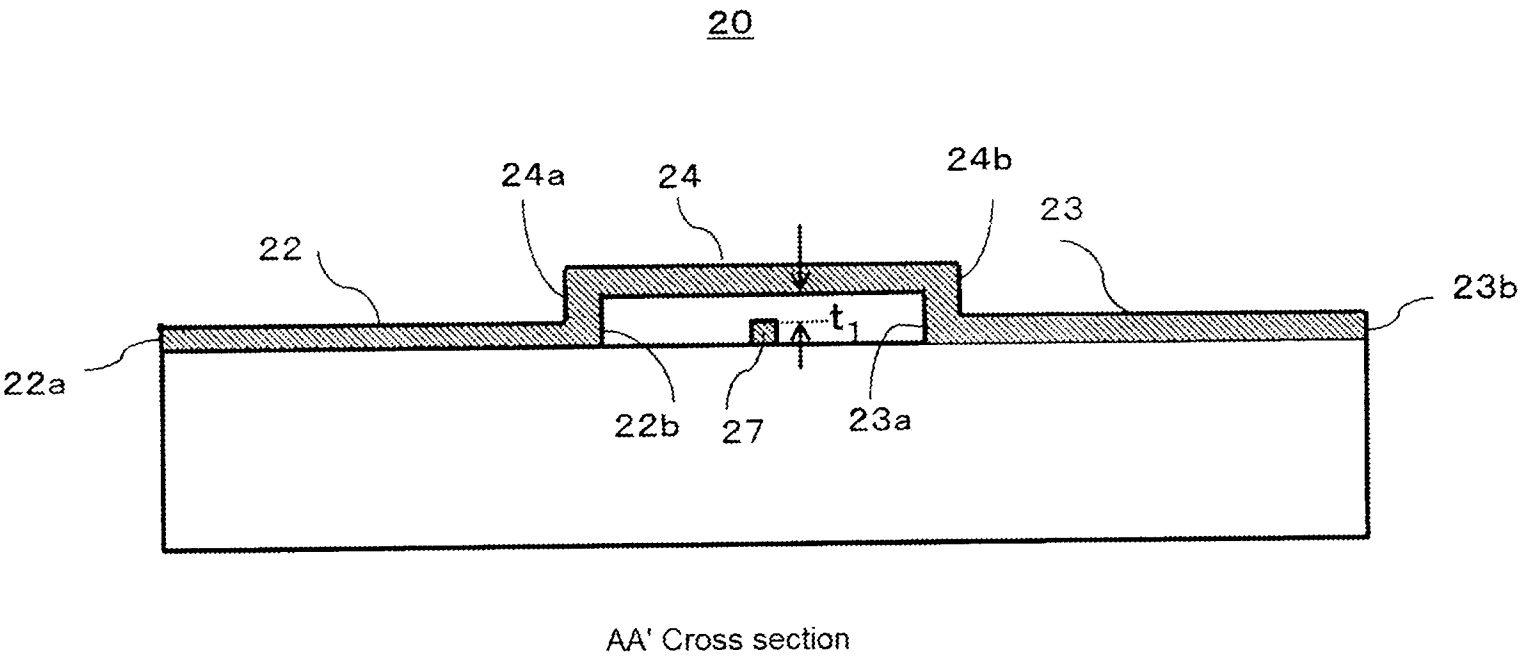
FIG. 4 is a cross-sectional view of the CPW line according to the first embodiment of the present invention.

FIG. 4 is a cross-sectional view of the CPW line 20 taken along a plane which includes AA' passing through the center of the central conductor and which is normal to the direction of the wiring 27. A gap is generated below the third central conductor 24 by the height $t_1$ of the erection portions 24*a* and 24*b* of the third central conductor 24. In the present embodiment, $t_1$=2 μm. The wiring 27 is formed so as to pass through the gap. Since there is a gap having the thickness $t_1$ between the lower surface of the central conductor 24 and the upper surface of the wiring 27, the central conductor 24 can intersect with the wiring 27 in a state where the central conductor 24 and the wiring 27 are electrically insulated. In such a manner, the central conductor 24 and the wiring 27 form an air bridge structure.

Figure 5:
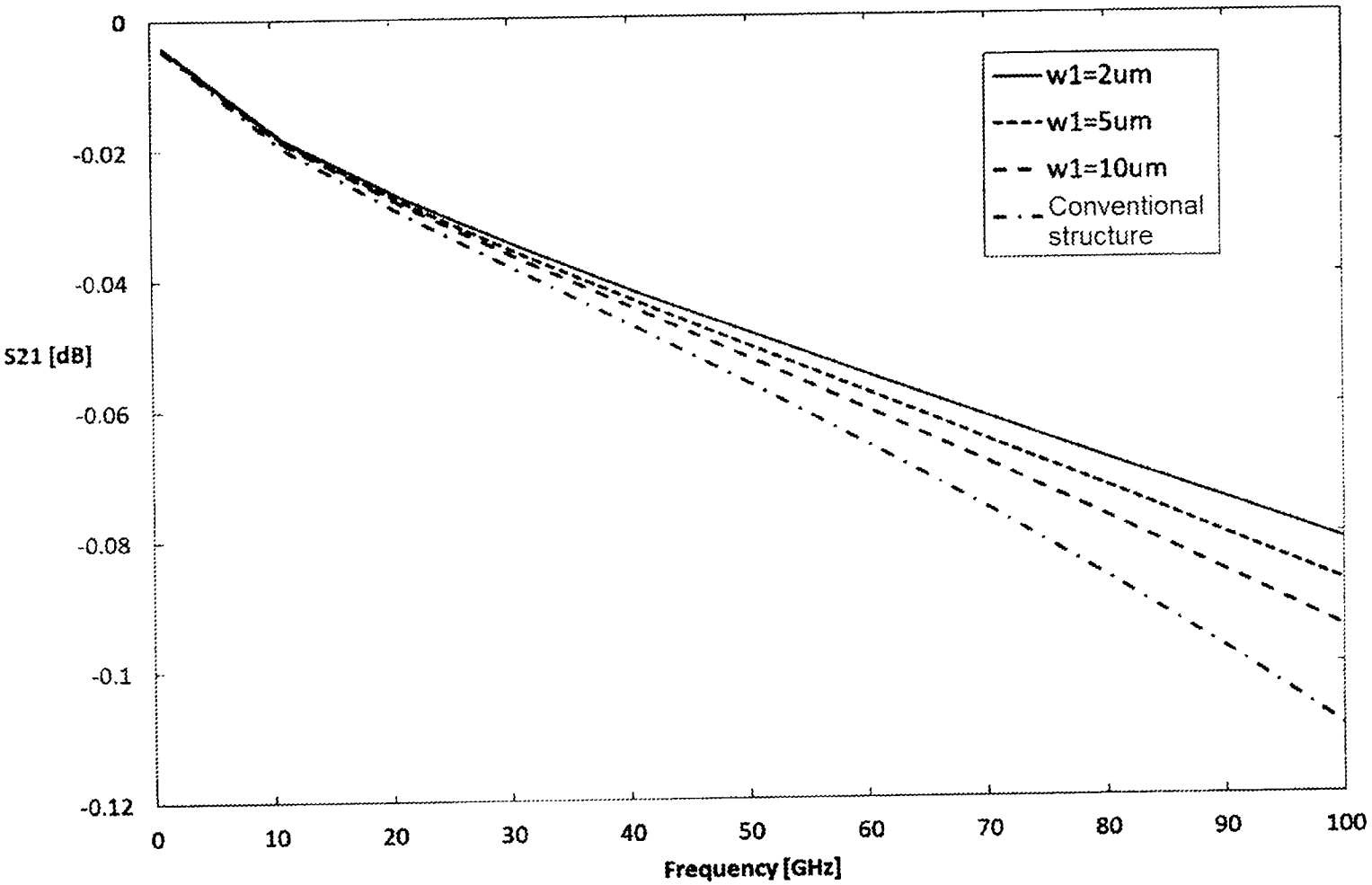
FIG. 5 is a simulation result of a transmission characteristic S21 of the CPW line according to the first embodiment of the present invention.
Figure 6:
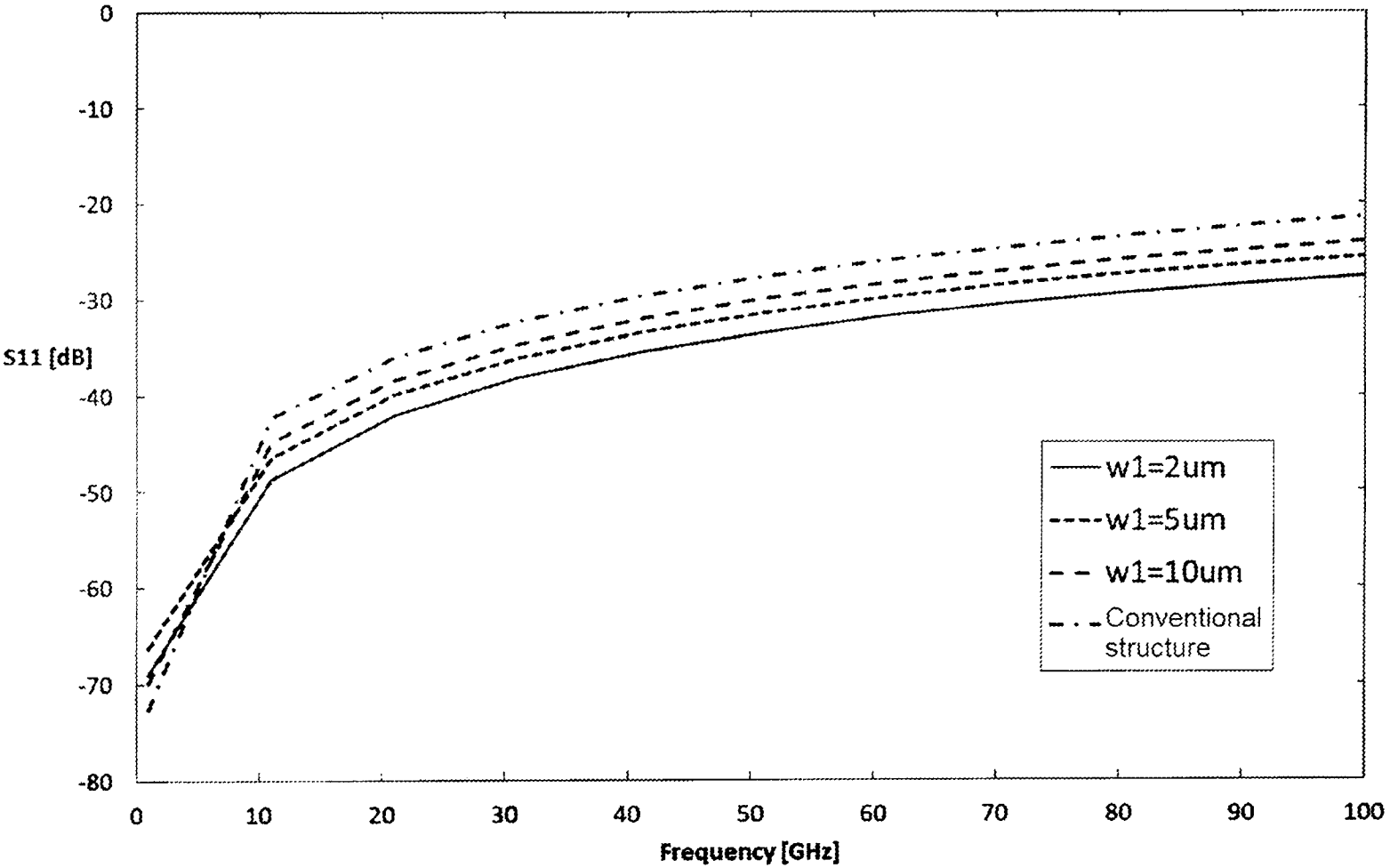
FIG. 6 is a simulation result of a reflection characteristic S11 of the CPW line according to the first embodiment of the present invention.
Figure 15:
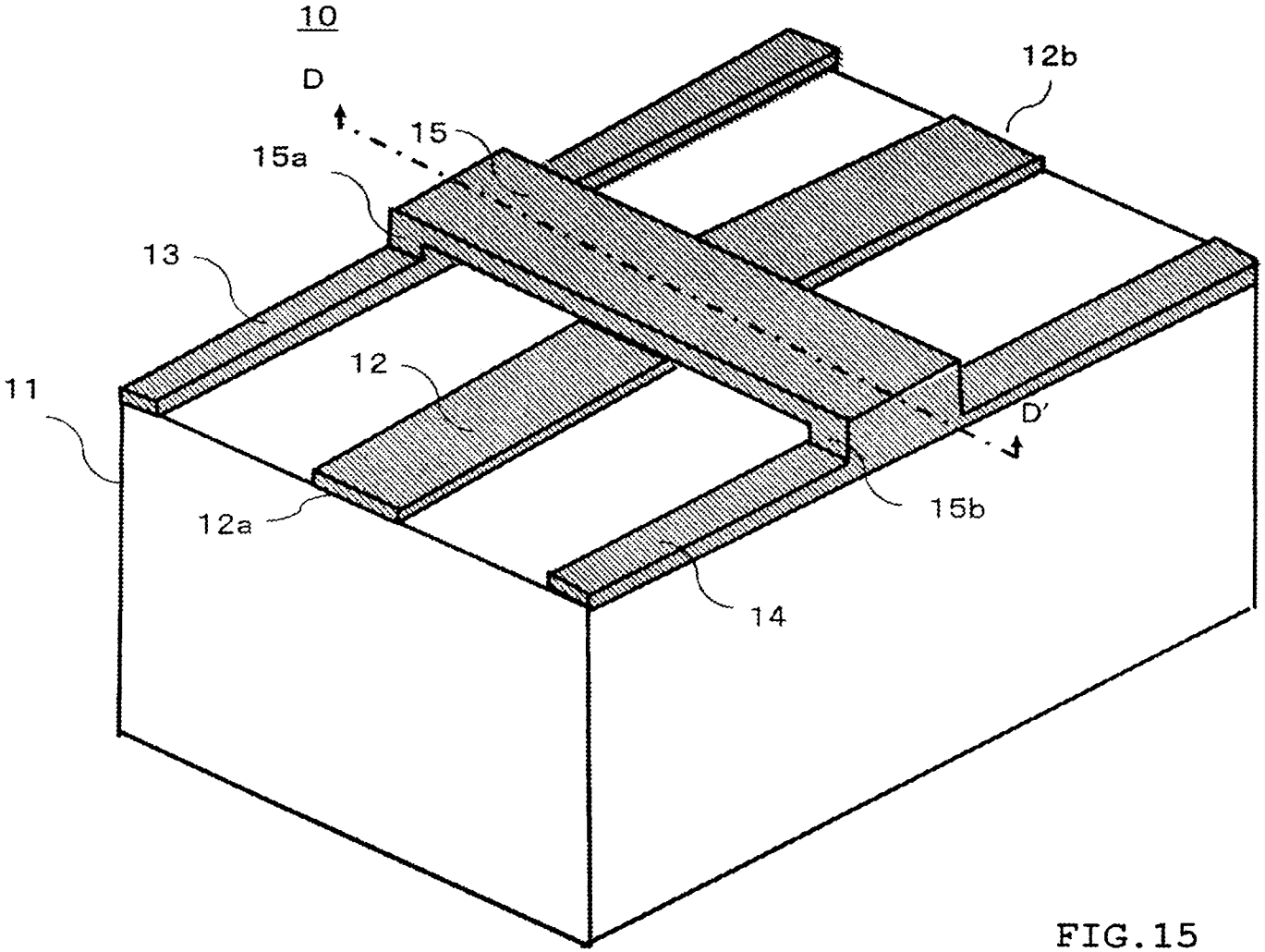
FIG. 15 is a diagram showing a configuration of a CPW line according to an embodiment in the prior art.
Figure 16:
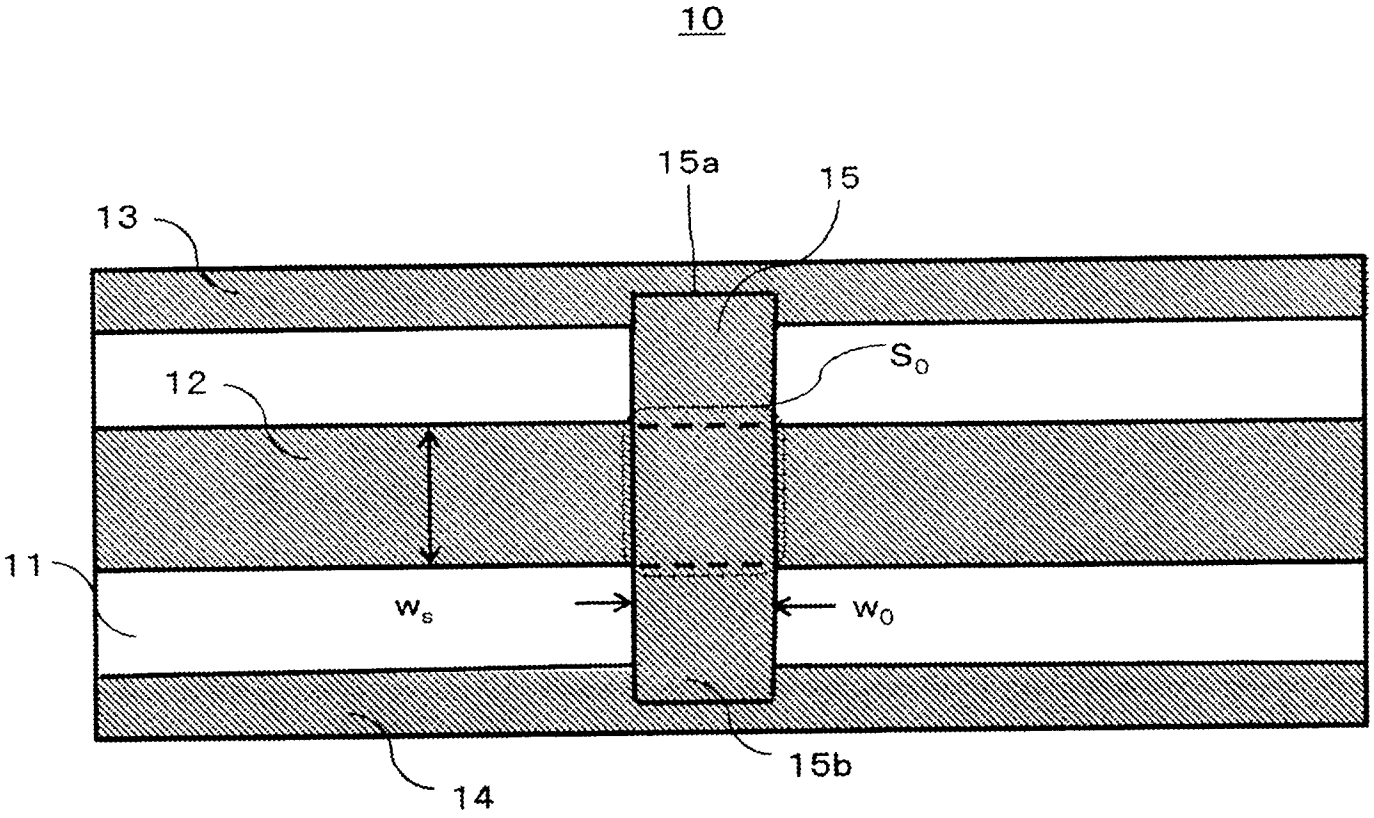
FIG. 16 is a top view of the CPW line according to the embodiment in the prior art.
Figure 17:
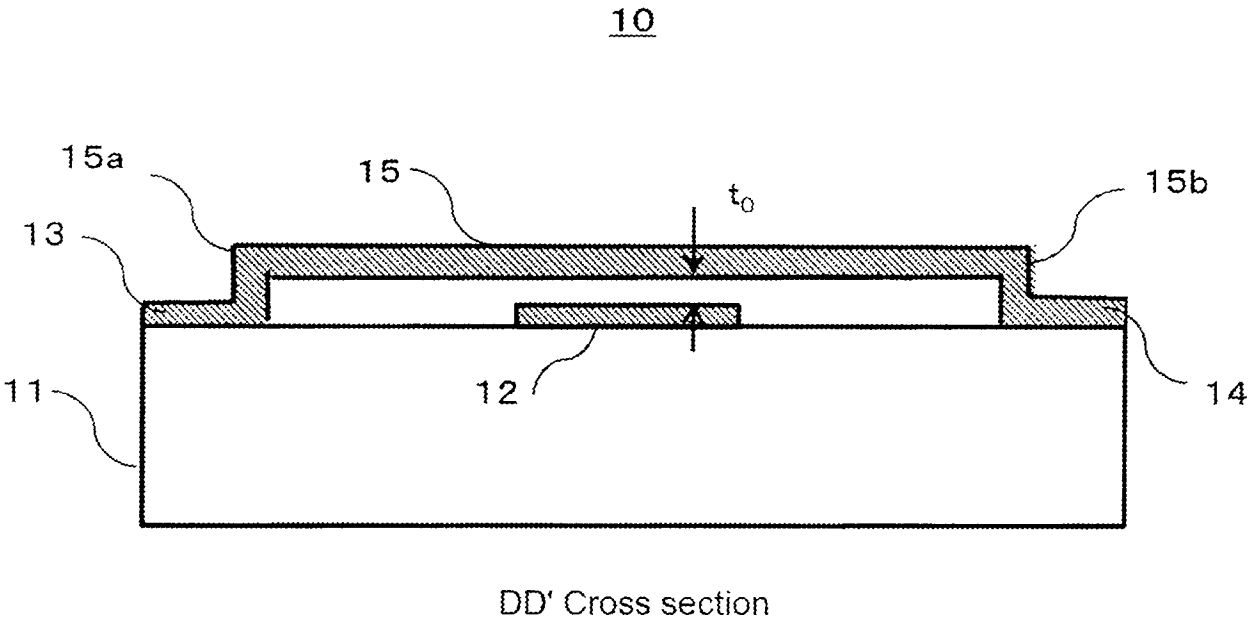
FIG. 17 is a cross-sectional view of the CPW line according to the embodiment in the prior art.

FIG. 5 shows a simulation result of the transmission characteristic S21 of the CPW line 20, and FIG. 6 shows a simulation result of a reflection characteristic S11 of the CPW line 10. The measurement frequency is set in a range from 1 GHz to 100 GHz. Three types of simulation models in which the width of the wiring 27 is 2 μm, 5 μm, and 10 μm are created for each of the CPW line 10 having the conventional air bridge structure shown in FIG. 15 and the CPW line 20 according to the first embodiment, and the models thereof are compared. As can be seen from the result of the transmission characteristic S21 in FIG. 5, a value of S21 is substantially higher for the CPW line 20 having the air bridge structure according to the first embodiment, and this relationship is established at all frequencies. For example, in the comparison at a frequency of 60 GHz, the following facts can be seen. In the conventional air bridge structure, the value of the transmission characteristic is −0.067 dB. In the air bridge structure of the present embodiment, if the width of the wiring 27 is narrowed to w1=10 μm, 5 μm, and 2 μm, the value of S21 becomes higher values of −0.061 dB, −0.059 dB, and −0.056 dB. As a result, as the width of the wiring 27 becomes narrower, the propagation loss becomes smaller.

As for the reflection characteristics, as shown by the simulation result of the reflection characteristic S11 in FIG. 6, it can be seen that the value of S11 is lower for the CPW line having the air bridge structure according to the present embodiment and this relationship is established at all frequencies. For example, in the comparison at the frequency of 60 GHz, the following facts can be seen. In the conventional air bridge structure, the value of the reflection characteristic is −26.02 dB. In the air bridge structure of the present embodiment, if the width of the wiring 27 is w1=10 μm, 5 μm, and 2 μm, the value of S11 becomes smaller values of −28.36 dB, −29.82 dB, and −31.82 dB. Therefore, it can be seen that the value of the reflection characteristic becomes smaller as the width of the wiring 27 becomes narrower.

The air bridge structure in which the central conductor is across the wiring in the present embodiment has a better characteristic than the conventional air bridge structure in which the wiring is across the central conductor. The reason for this is that an area of the intersection part of the central conductor and the wiring decreases.

That is, in the case of the conventional air bridge, wo=20 m and the area of the intersection part is 30×20 $\mu m^2$. On the other hand, in the air bridge structure according to the present embodiment, in the case of w1=2 μm, 5 μm, and 10 μm, the areas of the intersections are 60 $\mu m^2$, 150 $\mu m^2$, and 300 $\mu m^2$, respectively. In any case, the values of the areas are smaller than 600 $\mu m^2$ which is the area of the intersection part in the prior art. As a result, it is possible to reduce an electrostatic capacitance added to the CPW line.

It is not easy to reduce the area of the intersection part in the conventional air bridge structure. The reason for this is that, in a case where the width of the wiring is reduced in the configuration of the CPW line 10, the mechanical strength is insufficient, and the air bridge structure may be broken due to the influence of shaking or bending caused by a minute impact.

On the other hand, in the present embodiment, the wiring that connects the grounding conductor is in the same layer as the first central conductor 22 and the second central conductor 23, and the third central conductor 24 having the erection portion intersects with the wiring, thereby forming an air bridge structure. Since the width ws of the central conductor is 30 μm, which is relatively wide, the mechanical strength can be ensured even in a case where the air bridge structure is formed.

Figure 7A:
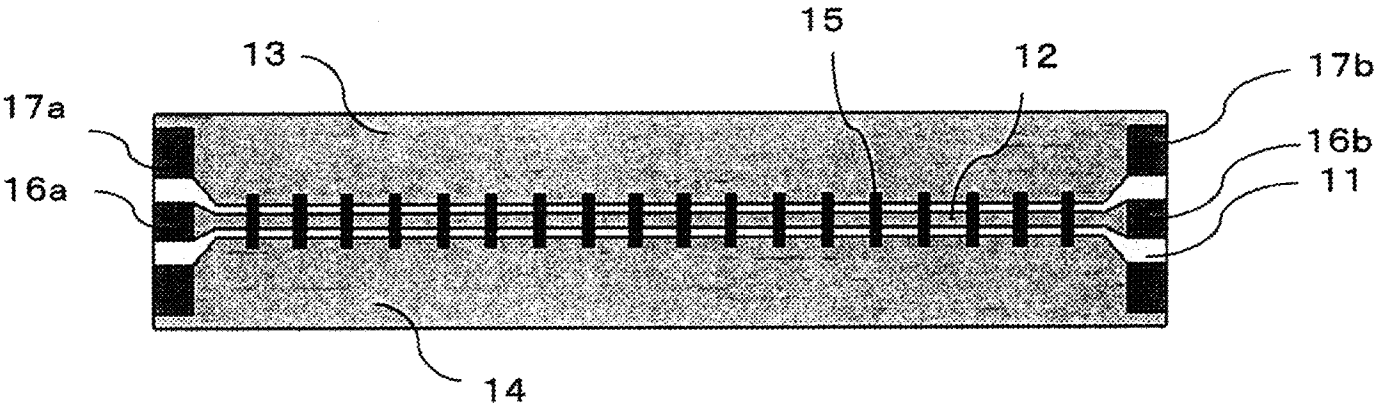
FIGS. 7A and 7B are test samples for actual measurement of S21 and S11, where
Figure 7B:
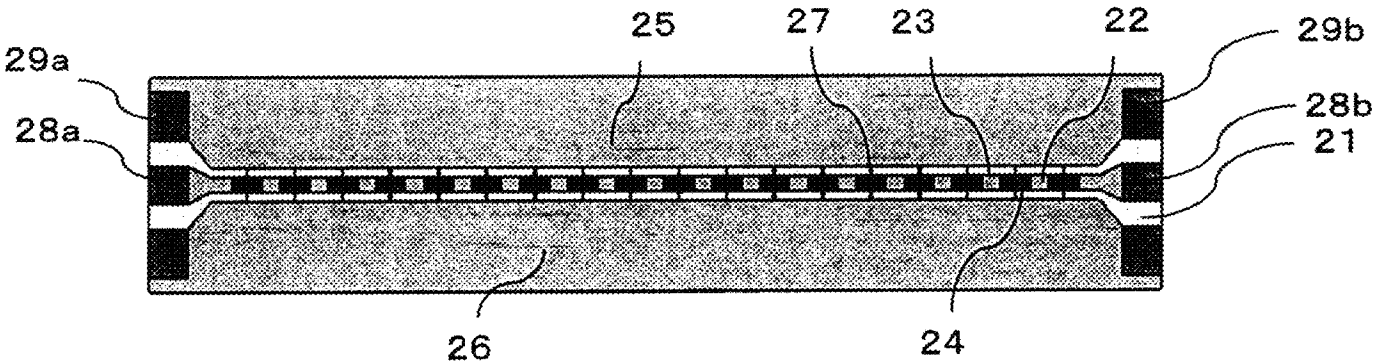

FIGS. 7A and 7B are diagrams of test samples used in a case of actually measuring transmission and reflection characteristics.

FIG. 7A shows a test sample of a CPW line having a conventional air bridge structure in which the wiring connecting the grounding conductors is across the central conductor. A pad 16*a* for applying a probe is formed on the central conductor on the input side, and a pad 17*a* is formed on the grounding conductor on the input side. Similarly, the pad 16*b* is formed on the central conductor on the output side, and the pad 17*b* is formed on the grounding conductor on the output side. The width ws of the central conductor is 30 μm, and the width wo of the wiring across the central conductor is 20 μm. In a test sample with a small number of air bridge structures, since the effect of the air bridge structure may not be detected, 18 air bridge structures are formed at equal intervals.

FIG. 7B is a diagram of the CPW line having the air bridge structure of the present embodiment in which the central conductor is above the wiring connecting the grounding conductors. The width ws of the central conductor is 30 μm, and the width w1 of the wiring is 2 μm. On the input side, a pad 28*a* for applying a probe is formed on the central conductor side, and a pad 29*a* is formed on the grounding conductor side. On the output side, the pad 28*b* and the pad 29*b* are formed in the same manner. The 18 air bridge structures are formed as in FIG. 7A.

Figure 8:
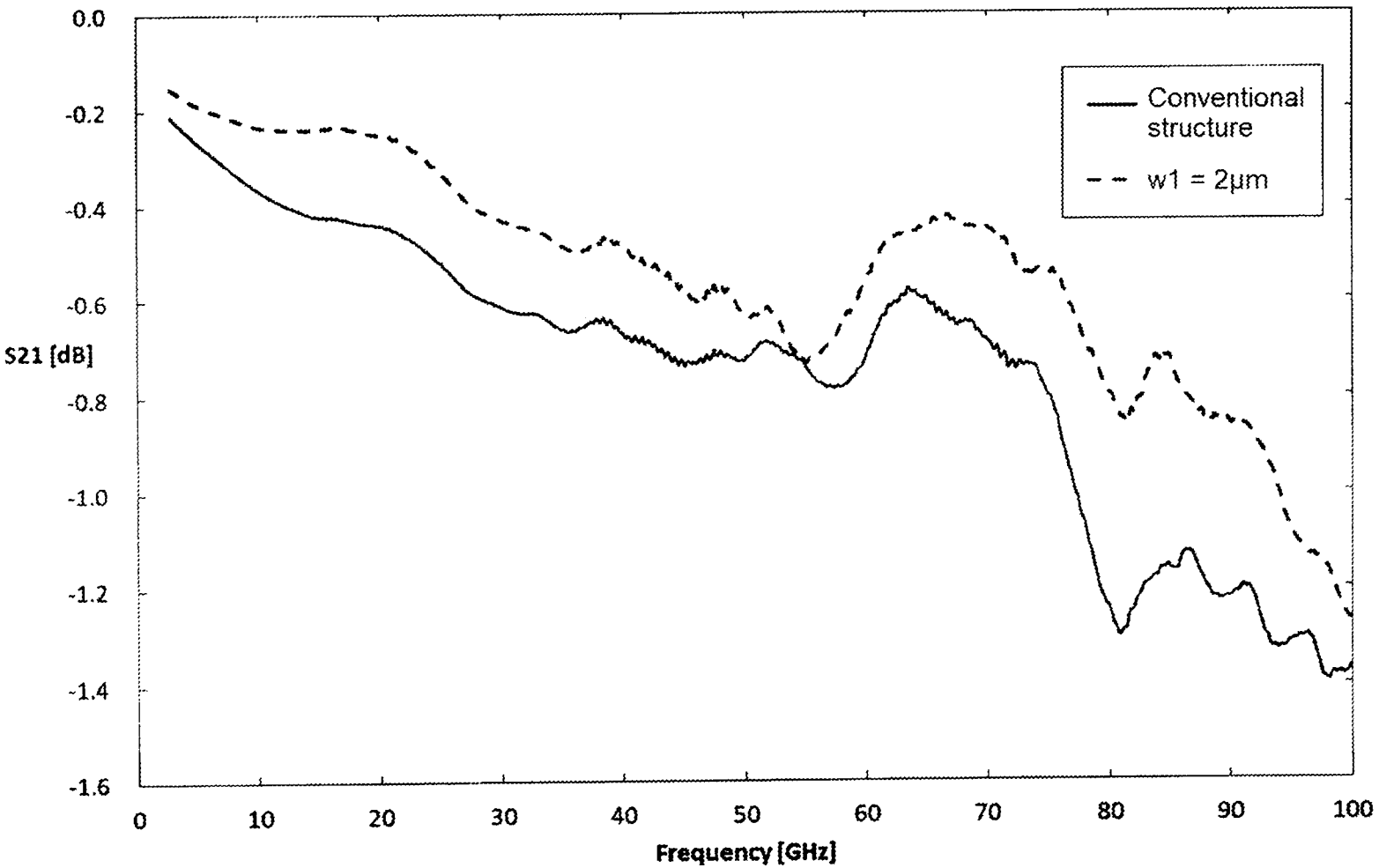
FIG. 8 is a measurement result of S21 of a test sample having a CPW line according to the first embodiment of the present invention.

FIG. 8 shows the characteristic of S21 of the test sample. The measurement frequency is set in a range from 3 GHz to 100 GHz. The result similar to the simulation is obtained. Therefore, it can be seen that, throughout the entire frequency range, the value of S21 is greater in the air bridge structure in which the central conductor according to the present embodiment is across the wiring than in the conventional air bridge structure in which the wiring is across the central conductor. Therefore, it is possible to realize a CPW line with less propagation loss by using an air bridge structure in which the central conductor passes over the wiring connecting the grounding conductors.

Further, in the present embodiment, the wiring 27 is disposed at a location where the distances $d_1$ and $d_2$ from the end portion of the central conductor are equal. $d_1$ and $d_2$ relate to the capacitance value formed by the wiring 27 and the central conductor. The electrostatic capacitance generated by the wiring connected to the central conductor and the grounding conductors is proportional to $1/d+1/d_2$. If a stationary point at which the electrostatic capacitance becomes the minimum value is obtained, the stationary point is a location at which $d_1=d_2$. Therefore, it is determined that the location at which $d_1=d_2$ is the optimum location for providing the wiring.

Second Embodiment

Next, a second embodiment of the present invention will be described. Description of the same parts as those in the first embodiment is omitted.

Figure 9:
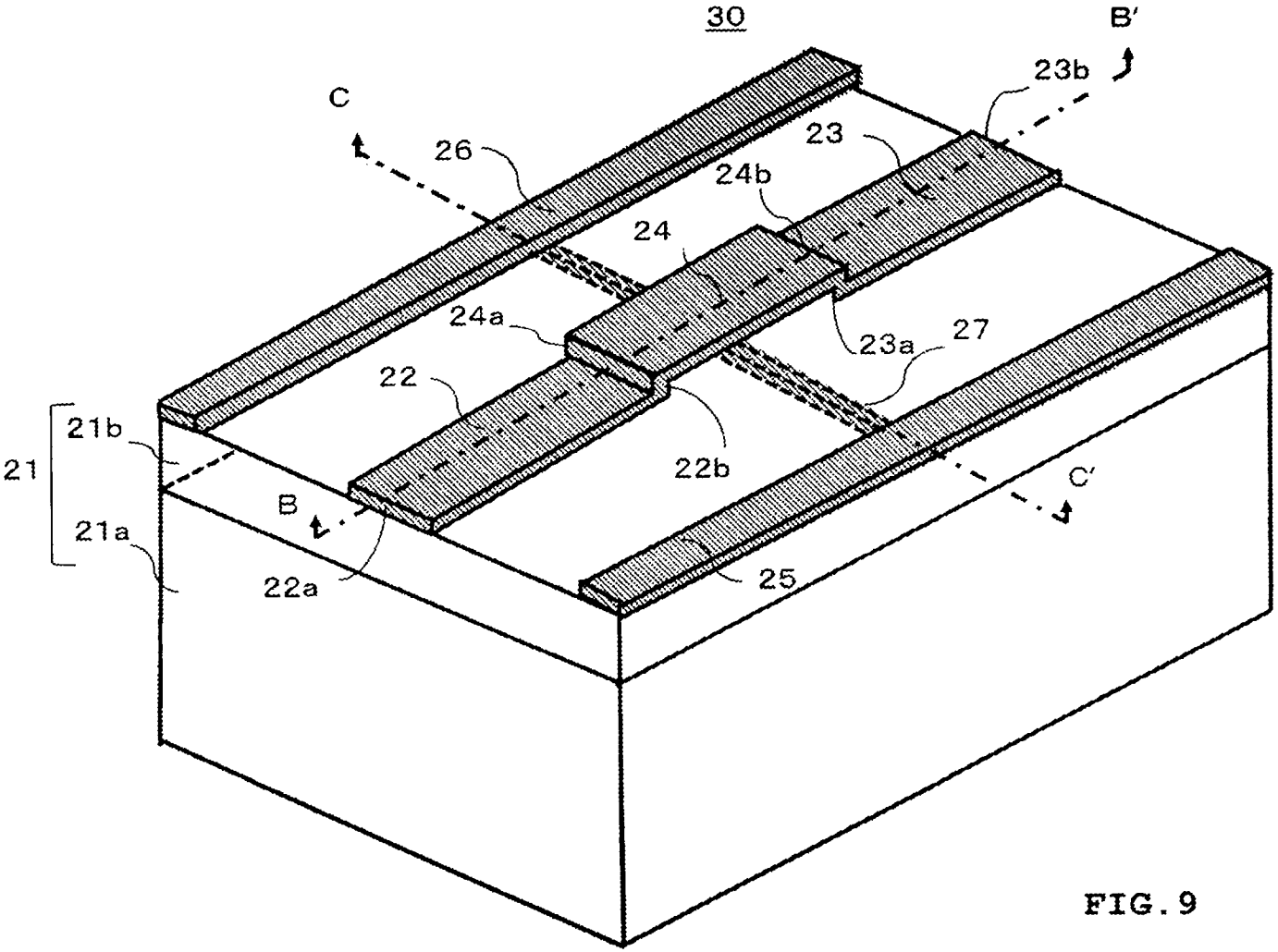
FIG. 9 is a diagram showing a configuration of a CPW line according to an embodiment of the present invention.

FIG. 9 shows a configuration of a CPW line 30 according to the second embodiment. The substrate 21 includes a substrate body 21*a* and an intermediate layer 21*b*. The wiring 27 connecting the grounding conductors 25 and 26 is formed on the surface of the substrate body by patterning or the like, and the intermediate layer 21*b* is formed so as to cover the upper surface of the substrate body 21*a* and the surface of the wiring 27. The substrate body 21*a* can be made of a material such as a semiconductor or a dielectric, and GaAs which is a compound semiconductor is used in this embodiment. The intermediate layer 21*b* is made of a semiconductor or a dielectric, and the thickness of the intermediate layer 21*b* is in a range of about 0.5 to 2 μm. The material of the substrate body 21*a* and the intermediate layer 21*b* may be formed of a single material or a combination of a plurality of materials, and can be set as appropriate.

The central conductors 22 and 23 and the grounding conductors 25 and 26 are formed on the upper surface of the intermediate layer 21*b*. Accordingly, the wiring 27 is formed on the upper surface of the substrate body 21*a*, and the grounding conductors 25 and 26 are formed on the upper surface of the intermediate layer 21*b*. In order to connect the grounding conductors 25 and 26, the grounding conductors 25 and 26 can be connected by the wiring 27 through holes such as through-holes provided in the intermediate layer 21*b*.

Figure 10:
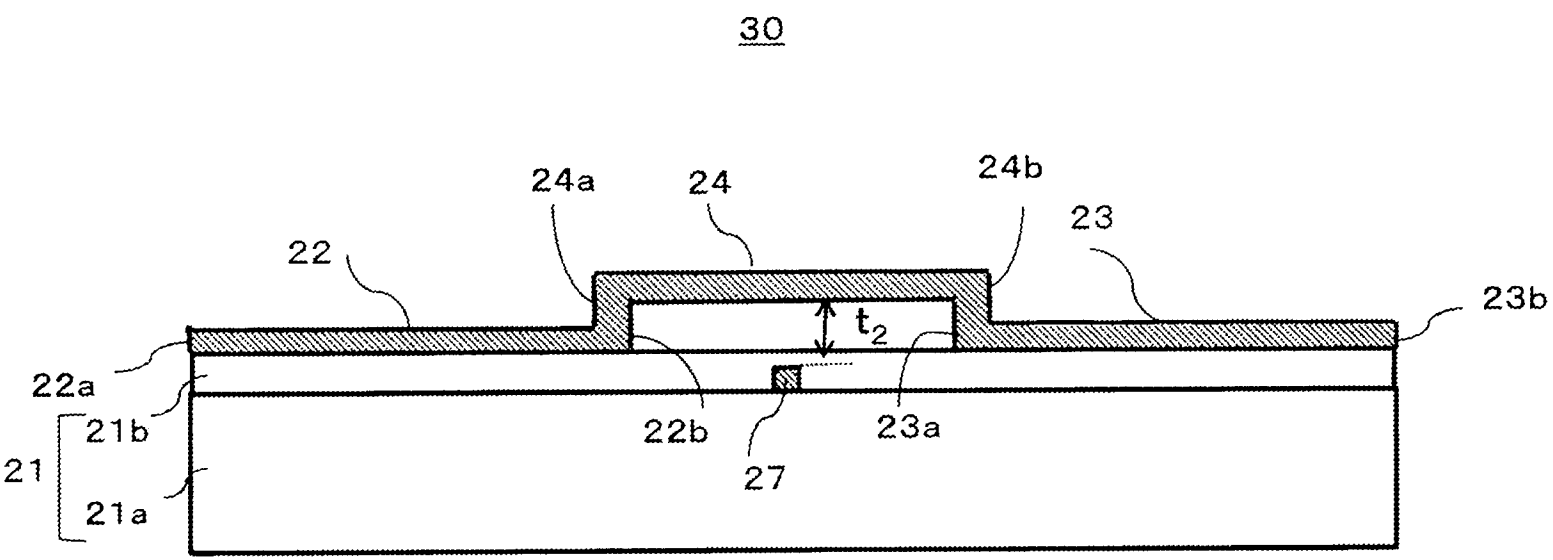
FIG. 10 is a cross-sectional view of the CPW line according to the embodiment of the present invention.

FIG. 10 is a cross-sectional view of the CPW line 30 in a case where the CPW line 30 is taken along a plane which includes the lead line BB' passing through the center of the width of the central conductors 22, 23, and 24 and which is normal to the direction of the wiring 27. The wiring 27 is provided on the upper surface of the substrate body 21*a*, and the central conductors 22 and 23 are provided on the upper surface of the intermediate layer 21*b*, which is a layer above the substrate body 21*a*. Further, the central conductor 24 is formed in a layer above the intermediate layer 21*b*, and an air bridge structure is formed in which the central conductor is across the wiring. Here, a distance between the upper surface of the wiring 27 and the lower surface of the central conductor 24 is $t_2$. The distance $t_2$ is obtained from the height $t_1$ of the erection portion, the thickness of the intermediate layer 21*b*, and the thickness of the wiring 27, and here, $t_2$=3.5 μm.

Figure 11:
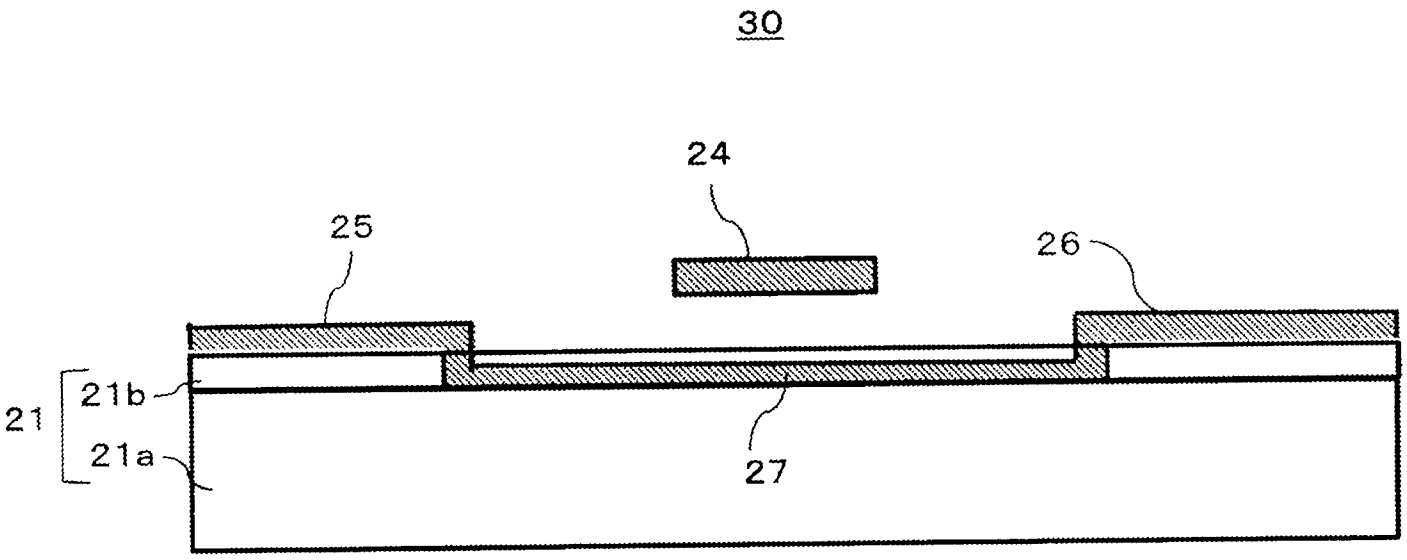
FIG. 11 is a cross-sectional view of the CPW line according to the embodiment of the present invention.

FIG. 11 is a cross-sectional view of the CPW line 30 in a case where the CPW line 30 is taken along a plane which includes the lead line CC' passing through the center of the width of the wiring and which is normal to the direction of the central conductor. The wiring 27 is provided on the upper surface of the substrate body 21*a*, and the grounding conductors 25 and 26 are provided on the upper surface of the intermediate layer 21*b*, which is a layer above the substrate body 21*a*. Further, the central conductor 24 is formed in a layer further above the grounding conductors 25 and 26, thereby forming an air bridge structure. The wiring 27 and the grounding conductors 25 and 26 in different layers are connected through through-holes formed near the edges of the grounding conductors.

By arranging the grounding conductors 25 and 26 and the wiring 27 in different layers, it is possible to prevent generation of a region surrounded by the metal film formed by the grounding conductors 25 and 26 and the wiring 27. For comparison, description will be focused on the substrate surface of the line in which the air bridge structures are repeatedly arranged as shown in FIG. 7B in the structure of the first embodiment.

Figure 12:
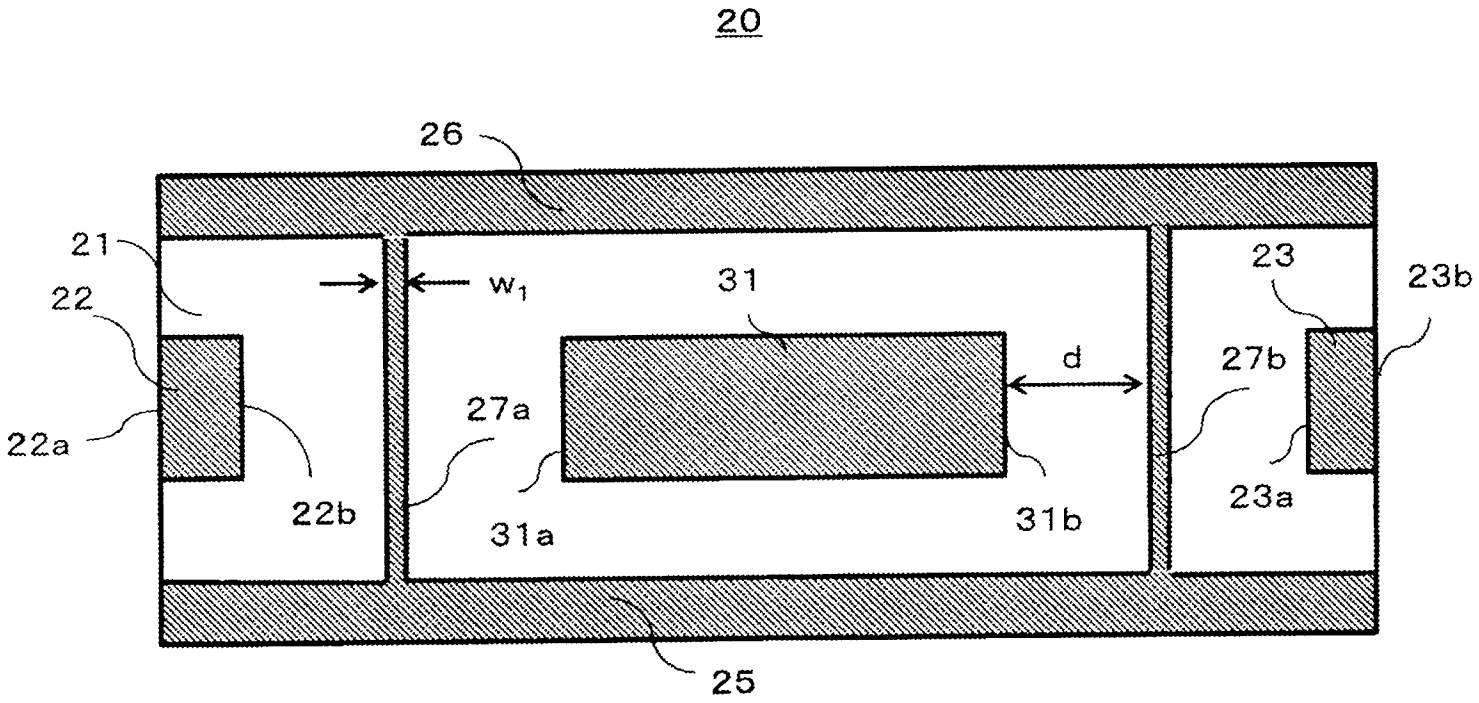
FIG. 12 is a cross-sectional view of the CPW line according to the embodiment of the present invention.

FIG. 12 is a cross-sectional view in a case where the CPW line 20 in which the air bridge structures of the first embodiment are repeatedly arranged is taken along the upper surfaces of the central conductors 22 and 23. As shown in FIG. 12, in the test pattern of FIG. 7B, the patterns for the central conductors and the wirings are alternately formed on the surface of the central conductor 22, the wiring 27*a*, the central conductor 31, the wiring 27*b*, the central conductor 23, and the substrate 21. Here, the wiring 27*a*, the central conductor 31, the wiring 27*b* and the grounding conductors 25 and 26 are arranged on the same surface of the upper surface of the substrate 21. Therefore, the region around the central conductor 31 is a region surrounded by the metal film of the grounding conductors 25 and 26 and the wirings 27*a* and 27*b*. In a case where there is a closed region surrounded by the metal film as described above, there is a concern that the lift-off property is deteriorated at the time of pattern formation and the pattern yield is lowered.

Figure 13:
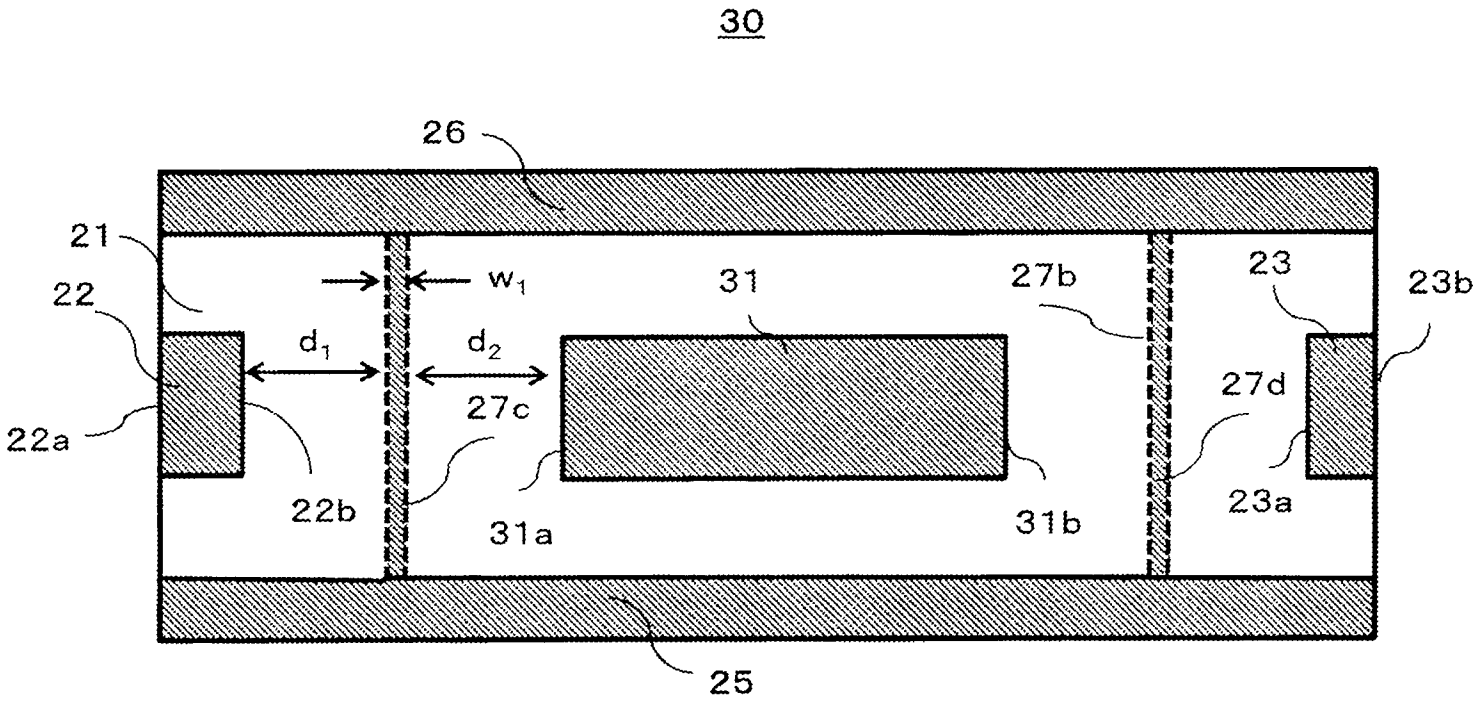
FIG. 13 is a cross-sectional view of the CPW line according to the embodiment of the present invention.

FIG. 13 is a cross-sectional view of the CPW line 30 in a case where the CPW line 30 in which the air bridge structures according to the second embodiment are repeatedly arranged is taken along the upper surface of the intermediate layer 21*b*. As shown in FIG. 13, the upper surface of the intermediate layer 21*b* has the central conductor 22, the central conductor 31, the central conductor 23, and the grounding conductors 25 and 26 arranged at the same interval, and the wirings 27*c* and 27*d* are formed on the upper surface of the substrate body 21*a* which is a layer different from the upper surface of the intermediate layer 21*b*, as indicated by dashed lines.

Figure 14:
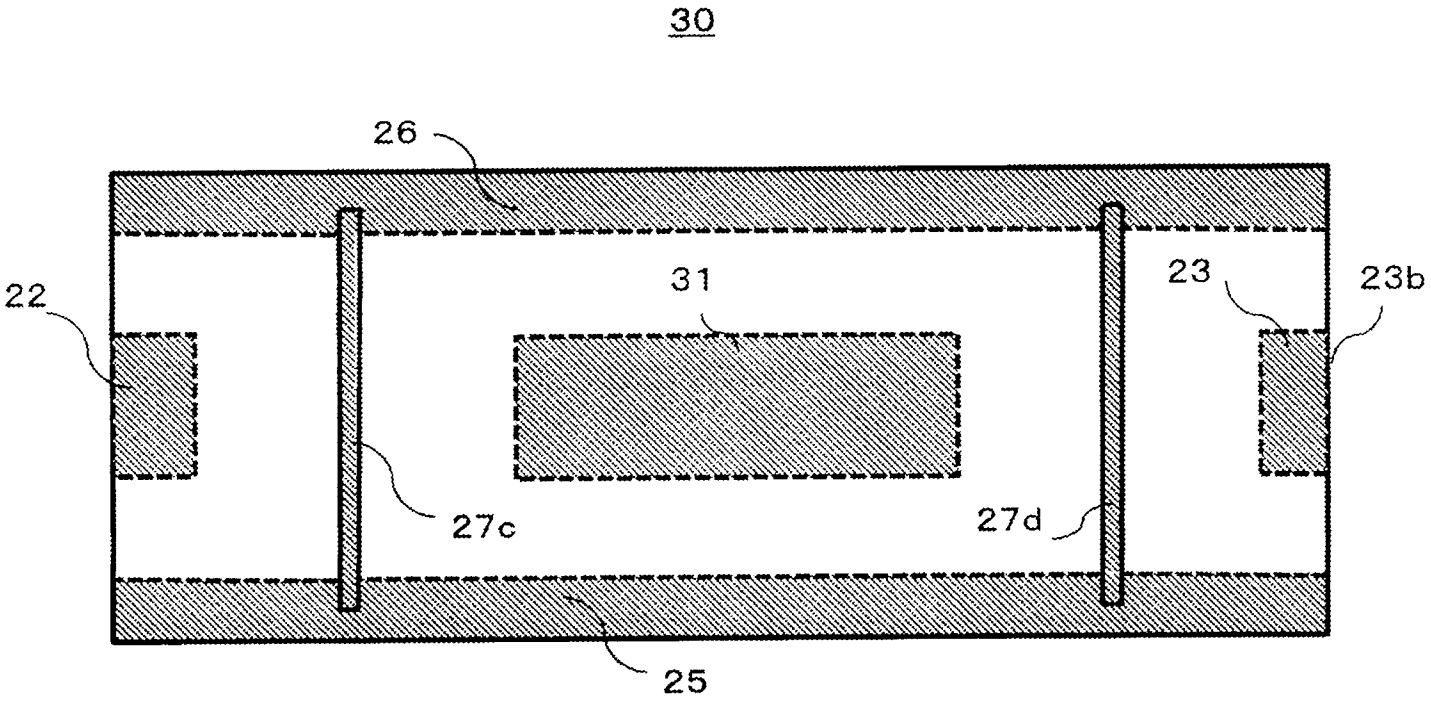
FIG. 14 is a cross-sectional view of the CPW line according to the embodiment of the present invention.

FIG. 14 is a cross-sectional view of the CPW line 30 in a case where the CPW line 30 in which the air bridge structures according to the second embodiment are repeatedly arranged is taken along the upper surface of the substrate body 21*a*. As shown in FIG. 14, wirings 27*c* and 27*d* connecting the grounding conductors 25 and 26 are formed on the upper surface of the substrate body 21*a*, which is a layer one layer below the intermediate layer 21*b*. Accordingly, the grounding conductors 25 and 26 and the wirings 27*c* and 27*d* indicated by dashed lines are respectively in different layers. Therefore, a closed region surrounded by the metal film of the grounding conductors 25 and 26 and the wirings 27*c* and 27*d* is not formed. Therefore, lift-off can be performed without difficulty, and a highly accurate pattern can be formed.

The present invention can be applied not only to the CPW line but also to a grounded coplanar line in which a ground electrode is provided on the entire back surface of the substrate.

DESCRIPTION OF REFERENCE NUMERALS AND SIGNS

20: CPW line
21: substrate
22, 23, 24: central conductor

25, 26: grounding conductor
27: wiring

What is claimed is:

1. A transmission line comprising:

a substrate;

a first central conductor and a second central conductor that are formed with a same width on a same straight line on one surface of the substrate, and a third central conductor that has a first erection portion and a second erection portion erected on the one surface;

a first grounding conductor and a second grounding conductor that have edges parallel to the first central conductor and the second central conductor and are separated from the first central conductor and the second central conductor by a same distance so as to be opposed to each other; and a third grounding conductor that connects the first grounding conductor and the second grounding conductor, is disposed between an end portion of the first central conductor and an end portion of the second central conductor facing the end portion of the first central conductor, and has a width narrower than a width of the third central conductor, wherein the first erection portion is disposed at the end portion of the first central conductor, and the second erection portion is disposed at the end portion of the second central conductor, and wherein the third central conductor and the third grounding conductor form an air bridge structure.

2. The transmission line according to claim 1, wherein the third grounding conductor is disposed at a center between the end portion of the first central conductor and the end portion of the second central conductor.

3. The transmission line according to claim 2, wherein the width of the third grounding conductor is ⅓ or less of the width of the third central conductor.

4. The transmission line according to claim 2, wherein the substrate is formed of a substrate body as a main body and a first layer on an upper surface of the substrate body, and wherein the third grounding conductor is disposed on the upper surface of the substrate body and is connected to the grounding conductors on an upper surface of the first layer.

5. The transmission line according to claim 1, wherein the width of the third grounding conductor is ⅓ or less of the width of the third central conductor.

6. The transmission line according to claim 5, wherein the substrate is formed of a substrate body as a main body and a first layer on an upper surface of the substrate body, and wherein the third grounding conductor is disposed on the upper surface of the substrate body and is connected to the first and second grounding conductors on an upper surface of the first layer.

7. The transmission line according to claim 1, wherein the substrate is formed of a substrate body as a main body and a first layer on an upper surface of the substrate body, and wherein the third grounding conductor is disposed on the upper surface of the substrate body and is connected to the first and second grounding conductors on an upper surface of the first layer.

8. An air bridge structure comprising:

a substrate;

central conductors provided on the substrate; and grounding conductors, wherein a part of one of the central conductors is separated from the substrate, and a part of one of the grounding conductors is disposed to pass under the part of the one of the central conductors, and wherein a width of the part of the one of the grounding conductors is narrower than a width of the part of the one of the central conductors.

9. The air bridge structure according to claim 8, wherein the central conductors include a first central conductor and a second central conductor that are formed with a same width on a same straight line on one surface of the substrate, and a third central conductor that has a first erection portion and a second erection portion erected on the one surface, wherein the grounding conductors include a first grounding conductor and a second grounding conductor that have edges parallel to the first central conductor and the second central conductor and are separated from the first central conductor and the second central conductor by a same distance so as to be opposed to each other, and a third grounding conductor that connects the first grounding conductor and the second grounding conductor, is disposed between an end portion of the first central conductor and an end portion of the second central conductor facing the end portion of the first central conductor, and has a width narrower than a width of the third central conductor, wherein the first erection portion is disposed at the end portion of the first central conductor, and the second erection portion is disposed at the end portion of the second central conductor, and wherein the third central conductor and the third grounding conductor form an air bridge structure.

10. The air bridge structure according to claim 9, wherein the third grounding conductor is disposed at a center between the end portion of the first central conductor and the end portion of the second central conductor.

11. The air bridge structure according to claim 10, wherein the substrate is formed of a substrate body as a main body and a first layer on an upper surface of the substrate body, and wherein the third grounding conductor is disposed on the upper surface of the substrate body and is connected to the grounding conductors on an upper surface of the first layer.

12. The air bridge structure according to claim 10, wherein the width of the third grounding conductor is ⅓ or less of the width of the third central conductor.

13. The air bridge structure according to claim 9, wherein the substrate is formed of a substrate body as a main body and a first layer on an upper surface of the substrate body, and wherein the third grounding conductor is disposed on the upper surface of the substrate body and is connected to the first and second grounding conductors on an upper surface of the first layer.

14. The air bridge structure according to claim 9, wherein the width of the third grounding conductor is ⅓ or less of the width of the third central conductor.

15. The transmission line according to claim 14, wherein the substrate is formed of a substrate body as a main body and a first layer on an upper surface of the substrate body, and wherein the third grounding conductor is disposed on the upper surface of the substrate body and is connected to the grounding conductors on an upper surface of the first layer.

* * * * *